US005131899A

United States Patent [19]

Nagahashi et al.

[11] Patent Number: 5,131,899

[45] Date of Patent: * Jul. 21, 1992

[54] MAGAZINE AND METHOD OF FEEDING ARTICLES

[75] Inventors: Toshio Nagahashi; Hisafumi Kobayashi; Minoru Sato, all of Chiba, Japan

[73] Assignee: Tokyo Automatic Machinery Works, Ltd., Tokyo, Japan

[*] Notice: The portion of the term of this patent subsequent to Oct. 15, 2008 has been disclaimed.

[21] Appl. No.: 428,981

[22] Filed: Oct. 30, 1989

Related U.S. Application Data

[63] Continuation-in-part of Ser. No. 292,422, Dec. 30, 1988.

[30] Foreign Application Priority Data

Apr. 27, 1988 [JP] Japan ..... 1-110300
Apr. 28, 1988 [JP] Japan ..... 63-107897

[51] Int. Cl.[5] ..... B65H 3/08; B65H 3/34

[52] U.S. Cl. ..... 493/317; 271/99; 271/104; 271/150; 271/155; 271/31.1; 414/798.9; 493/122

[58] Field of Search ..... 493/122, 123, 126, 315-318, 493/124, 125, 127; 271/5, 99, 104, 265, 198, 314, 31.1, 149, 150, 155, 166; 414/798.1, 798.9

[56] References Cited

U.S. PATENT DOCUMENTS

| | | | |
|---|---|---|---|
| 1,739,153 | 12/1929 | Laxo et al. | 271/166 X |
| 2,699,712 | 1/1955 | Meyer-Jagenberg et al. | 493/316 |
| 3,680,854 | 8/1972 | Daily et al. | 271/166 |
| 3,858,490 | 1/1975 | Heisler | 493/316 |
| 4,157,058 | 6/1979 | Vogel | 493/124 |
| 4,582,315 | 4/1986 | Scarpa | 271/150 |
| 4,596,545 | 6/1986 | Greenwell | 493/318 |

FOREIGN PATENT DOCUMENTS

| | | | |
|---|---|---|---|
| 282478 | 3/1915 | Fed. Rep. of Germany | 271/150 |
| 59-26833 | 2/1984 | Japan . | |

*Primary Examiner*—James G. Smith
*Assistant Examiner*—Jack Lavinder
*Attorney, Agent, or Firm*—Sandler, Greenblum & Bernstein

[57] ABSTRACT

A magazine for holding a plurality of articles, such as cartons, which are to be singularly withdrawn at a downstream end, and a method of feeding articles. The magazine includes guides, spaced apart by a distance greater than the width of the cartons in their folded condition, thereby creating a gap between an inner guide surface and one of the edges of the cartons. A pair of stoppers oppositely project toward each other and are spaced apart by a distance less than the width of the cartons, to thereby hold the most downstream carton in a position to facilitate its withdrawal at the discharge end of the magazine. The stoppers are positioned to engage the particular edges of the cartons of which the distance between them is not apt to be variable, to thereby reduce the likelihood of the cartons becoming jammed within the magazine. At least one feed roller projects from one inner guide surface toward the other inner guide surface upstream of the discharge end. At least one carton is engaged between the roller and the other inner guide surface to isolate a predetermined number of folded cartons downstream of the feed roller from a second predetermined quantity of folded cartons upstream of the feed roller. Further, due to the engagement of the edges of the most downstream carton and the stoppers, as the carton is withdrawn from the magazine, the carton is more fully opened to thereby facilitate its subsequent complete opening. A supply conveyor is provided upstream of the guide surfaces. The supply conveyor and the feed roller can be driven synchronously in response to the sensing of a reduction in the quantity of cartons in the downstream portion of the magazine.

49 Claims, 6 Drawing Sheets

MAGAZINE AND METHOD OF FEEDING ARTICLES

This application is a continuation-in-part of application Ser. No. 07/292,422, still pending, which was filed on Dec. 30, 1988, the subject matter of which is hereby incorporated by reference thereto.

BACKGROUND OF THE INVENTION

1. Field of the Invention

The present invention relates to a magazine for holding a large number of substantially flat articles, flatwise folded cartons in particular, in a stacked condition between a pair of substantially parallel guides and, more particularly, to a magazine for releasing such articles or cartons one-by-one from downstream end portions of a pair of guides after which the articles, such as cartons, can be opened using a mechanism such as a suction cup.

2. Description of Background and Pertinent Information

According to a conventional magazine of this type, for example, as disclosed in Japanese Laid-Open Patent Application No. 26833/84, a pair of inclined guides are spaced from each other by a distance less than a vertical width of each folded carton to form a restriction, thereby making it difficult for pressure on the upstream side to be applied to the cartons on the downstream side. A small detent or flap-engaging pin is provided at a discharge end portion to prevent accidental discharge of a carton located at the extreme end of the downstream side. Further, a horizontal conveyer for carrying a large quantity of cartons thereon in an upright condition is disposed on the upstream side of the lower guide, which conveyer is driven upon detection of a positional change of the upper edges of the upright cartons as the cartons are withdrawn, to supply cartons intermittently in a quantity matching the quantity of the cartons withdrawn from the magazine. By this construction, the resistance of each carton being withdrawn is minimized to permit cartons to be withdrawn relatively easily.

3. Problems to be Solved by the Invention

The conventional magazine is constructed so that the cartons contained therein are subject to approximately equal pressures from the upstream cartons and both upper and lower edges thereof come into engagement with the above restriction, allowing the cartons to slide downstream successively every time a carton located at the downstream end is withdrawn. However, since the magazine is intended to hold not only flatwise folded cartons but also flat base papers and folded leaflets, there arises the problem that the specific and unique characteristics of cartons are ignored, resulting in relatively unsatisfactory handling of cartons.

The present invention has been effected, in particular, in consideration of the properties peculiar to folded cartons.

A folded carton tends to open by virtue of the stiffness of the base paper from which it is made. The degree of expansion of a carton varies depending upon the difference in the quality or dimensional accuracy of the base paper, or the difference in the storage time in a folded state. But such folded cartons tend to open at all times. Consequently, the aforementioned restriction does not have the desired effect on all of the cartons; the pressure induced thereby may be imposed on the carton located at the downstream end; and there arises the necessity of taking some countermeasure against sudden discharge of cartons at the discharge end of the magazine.

In order to overcome the problems mentioned above, it is important to make the vertical width of each carton relatively uniform and it is necessary to limit the quality of paper and to improve the dimensional accuracy of storage standard. However, these solutions present the problem of increased material costs.

In particular, since the cartons are normally formed into containers by overlapping both edges of the original cut sheet and then securing them to each other, the positions of the overlapped, secured edges are apt to be displaced, and are apt to vary from carton to carton, and their edge-to-edge dimensions in a direction perpendicular to the direction of the folding lines of the cartons tend to be easily disturbed, resulting in that in case that both edges in a direction perpendicular to the direction of the folding lines of the cartons which are to be held between the paired guides as found in the above-mentioned prior art, it presents a problem that the cartons may easily be jammed between the the two guides and the most downstream carton may accidentally be discharged, or the force required to remove the carton may become high in order to prevent the accidental discharging operation.

The aforementioned property of each folded carton tending to open creates an expansive elasticity in the stacked direction of the cartons in the magazine. However, since such elasticity itself is not a large force, this property is utilized effectively by reducing the urging force or gravity of the succeeding cartons and the frictional resistance of the flow of cartons. That is, it is important that the carton being withdrawn convert its vertical compression into an opening action in which it tends to expand in the stacked direction at the discharge end of the magazine.

In the above-mentioned conventional magazine, an additional pressure from the upstream side is applied to a minimum extent to the carton located at the downstream end. Conversely, when cartons are pushed back from the downstream to the upstream side by a mechanism assisting in their successive release from the magazine, the cartons are further compressed so greatly that it is almost impossible to push the cartons back by such a mechanism. Further, it is difficult to open the cartons because they are withdrawn in a compressed condition.

In the foregoing description of the conventional magazine, moreover, cartons in a quantity corresponding to the quantity of the cartons withdrawn from the downstream end are replenished by driving the horizontal conveyer upon detection of a degree of tilting of the cartons which are carried upright on the horizontal conveyer. So where the row of the cartons on the horizontal conveyer for detecting the degree of tilting of the cartons is not long, it becomes difficult to effect the detection, resulting in deteriorated responsibility for control and the necessity of a wider mounting space for the magazine.

SUMMARY OF THE INVENTION

It is an object of the present invention to overcome the problems in the prior art by providing a magazine for holding a plurality of stacked, flatwise folded cartons which are to be singularly withdrawn therefrom at a downstream end thereof,.the magazine including a first guide and a second guide each having a respective inner surface between which the stacked cartons are held, the first guide and the second guide being spaced apart by a distance greater than a given distance between a pair of edges of respective cartons in their flatwise folded condition, thereby creating a gap between one of the first and second guides and one of the pair of edges of respective cartons; a first stopper and a second stopper oppositely projecting from respective portions of the magazine toward each other, and spaced apart by a distance less than a given distance between a pair of edges of the cartons; at least one feed roller, at least a portion of which projects from the second inner guide surface toward the first inner guide surface and is spaced from the first inner guide surface by a distance less than the given distance between the pair of edges of the respective cartons; means for driving the feed roller for rotation toward the downstream end of the magazine; and a sensor operatively associated with the driving means for controlling the rotation of the feed roller as a function of the quantity of cartons positioned downstream of the feed roller.

According to a further aspect of the invention, each of the stoppers has a curved or inclined inner end face such that a spacing is defined between the inner end face of the first stopper and the inner end face of the second stopper which gradually decreases toward the downstream end of the magazine.

A further aspect of the invention includes a supply conveyor having a conveyance portion disposed upstream of the second guide for supplying a plurality of cartons, wherein the conveyance portion is adapted to be driven in synchronism with the feed roller.

According to a further aspect of the invention, the feed roller is mounted for selective adjustment toward and away from the downstream end of the magazine.

According to a still further aspect of the invention, the distance between which the first and second guides are spaced apart is greater downstream of the feed roller than the distance upstream of the feed roller.

According to a still further aspect of the invention, the first and second stoppers are positioned relative to the remainder of the magazine so as to be adapted to engage opposite edges of the folded cartons, which edges are spaced from each other in the direction of folding lines of the folded cartons.

In a further aspect of the invention, the second guide is a lower guide for supporting the cartons, the magazine further includes a third stopper projecting upwardly from the lower guide, and the first and second stoppers project generally perpendicularly to the third stopper.

A further object of the invention is to provide an apparatus for storing articles in a supply, the articles having fold lines which extend in a predetermined direction, and at least a pair of edges which are spaced from each other in the predetermined direction, and for facilitating withdrawal of the articles from the supply, the apparatus including:

(a) means for guiding the articles for movement from an upstream position to a downstream position;

(b) a discharge end located at the most downstream portion of the guiding means from which the articles can be withdrawn from the supply;

(c) means separate from said guiding means and located along the guiding means, upstream of the discharge end for substantially isolating a first predetermined number. of the articles in the supply from the pressure created by a second predetermined number of the articles positioned upstream of the first predetermined number of the articles; and (d) at least a pair of stoppers which are positioned downstream of the isolating means so as to be adapted to engage the pair of edges.

According to a particular aspect of the invention, the guiding means includes at least two generally parallel guide surfaces. The guide surfaces are spaced apart by a distance downstream of the isolating means greater than a distance upstream of the isolating means.

According to a further aspect of the invention, the guide surfaces include a lower guide surface upon which a plurality of the articles within the supply are to be supported, and an upper guide surface adapted to be spaced from the lower guide surface at a distance greater than a predetermined width dimension of one of the articles.

According to a still further aspect of the invention, the means for isolating includes means for temporarily engaging at least one of the articles in the supply. The means for isolating is also adapted to engage and advance at least one of the articles in the supply towards the discharge end of the supply and is, preferably, are intermittently driven roller.

According to a still further aspect of the invention, the means for isolating comprises means projecting from one of the two guide surfaces which is adjustable toward and away from the other of the two guide surfaces.

According to a still further aspect of the invention, the means for guiding includes at least two guide surfaces, wherein the roller is positioned proximate one of the guide surfaces and at least partially projects therefrom toward a second of the guide surfaces so as to be spaced therefrom by a distance less than a predetermined width dimension of one of the articles.

According to a still further aspect of the invention, the articles are flatwise folded cartons and the means for isolating a first predetermined number of the articles further includes means for at least partially opening the folded cartons, which can include a first projection proximate the discharge end, projecting from one of the guide surfaces, and a second projection proximate the discharge end, projecting from a second of the guide surfaces. The first projection and the second projection are spaced apart by a distance less that a width dimension of at least one of the cartons such that, upon engagement of a first portion of a respective carton at the discharge end by a withdrawal mechanism for withdrawing the respective carton from the supply, second and third opposed portions of the carton engage respective portions of the first and second projections to thereby enable the respective carton to be at least partially opened. A withdrawal mechanism, such as a vacuum gripper, engages the first portion of a respective carton.

According to a still further aspect of the invention, the first and second projections include respective surfaces which converge toward the discharge end of the apparatus. These surfaces can be generally planar or can be curved.

It is a further object of the invention to provide an apparatus for storing articles in a supply and for facilitating withdrawal of the articles from the supply, the apparatus comprising:

(a) means for guiding the articles for movement from an upstream position to a downstream position comprising at least two spaced apart guide surfaces having respective upstream portions and downstream portions;

(b) a discharge end located at the most downstream portion of the guiding means from which the articles can be withdrawn from the supply, the two guide surfaces being spaced apart, at least at the discharge end, by a distance greater than a predetermined width dimension of one of the articles and wherein the distance between the two guide surfaces is greater downstream than upstream; and (c) means located along the guiding means, upstream of the discharge end, for substantially isolating a first predetermined number of the particles in the supply from the pressure created by a second predetermined number of the articles positioned upstream of the first predetermined number of the articles.

According to a particular aspect of the invention, the two guide surfaces comprise a lower surface and an upper surface and the upper surface comprises a stepped portion projecting closer to the lower surface than the remainder of the upper surface, the stepped portion being spaced from the discharge end and extending upstream therefrom.

According to another aspect of the invention, the two guide surfaces comprise a lower surface and an upper surface and wherein the lower surface includes an upstream portion and a downstream portion, and the downstream portion is spaced from the upper surface by a distance greater than that of the upstream portion.

It is a further object of the invention to provide a method of feeding flatwise folded cartons, each having a predetermined width, through a magazine, from an upstream portion to a downstream portion, and of facilitating withdrawal of the cartons from the magazine comprising:

(a) creating a supply of stacked cartons within the magazine;

(b) guiding the folded cartons within the magazine between an upstream position to a downstream end by means of at least a pair of generally parallel guide surfaces spaced apart, at least at the downstream portion of the magazine, by a distance greater than the predetermined width of said cartons to thereby define a gap between a first edge of each of the stacked cartons and one of the guide surfaces;

(c) engaging a respective second edge of at least one of the cartons within the magazine and moving the cartons toward and against a second of the guide surfaces to thereby isolate an upstream quantity of cartons from a downstream quantity of cartons; and (d) engaging opposite end portions of successive cartons at a discharge end of the magazine at which the cartons are successively withdrawn, the end portions being spaced from each other in the general direction in which fold lines of the cartons extend.

The method further includes the step of engaging, at the discharge end of the magazine, an edge portion which extends generally parallel to the fold lines of the cartons.

The present invention will now be described by way of non-limiting embodiments with reference to the accompanying exemplary drawings, in which:

FIGS. 1 to 4 illustrate a first embodiment of the present invention wherein:

FIG. 1 is a longitudinal sectional view, partially illustrating a magazine according to an embodiment. of the present invention;

FIG. 2 is a sectional view taken along line (II)—(II) of FIG. 1;

FIG. 3 is a side view, in partial longitudinal section, showing the whole of the magazine, including a conveyance portion for supplying a large quantity of cartons installed in a substantially horizontal condition;

FIG. 4 is a view similar to that of FIG. 3, showing the same conveyance portion in an inclined condition;

FIGS. 5 to 11 illustrate another embodiment of the present invention wherein:

FIG. 5 is a partial longitudinal and side elevational section of a magazine in which a mounting position of the feed roller can be adjusted toward a carton stacking direction;

FIG. 6 is a sectional view taken along a line (VI)—(VI) of FIG. 5;

FIGS. 7 and 8 are partial longitudinal and side elevational sections of a magazine in which an edge-to-edge distance between the inner surfaces of the guides located at the downstream side of the feed roller is made larger than that of the upstream side of the feed roller;

FIG. 9 is a sectional view taken along a line (IX-)—(IX) of FIG. 8,

FIG. 10 is a sectional view taken along a line (X)—(X) of FIG. 9; and

FIG. 11 is a partial longitudinal and side elevational section of a magazine having projections at the inner surface of one guide.

DETAILED DESCRIPTION OF PREFERRED EMBODIMENTS

Figure 1:
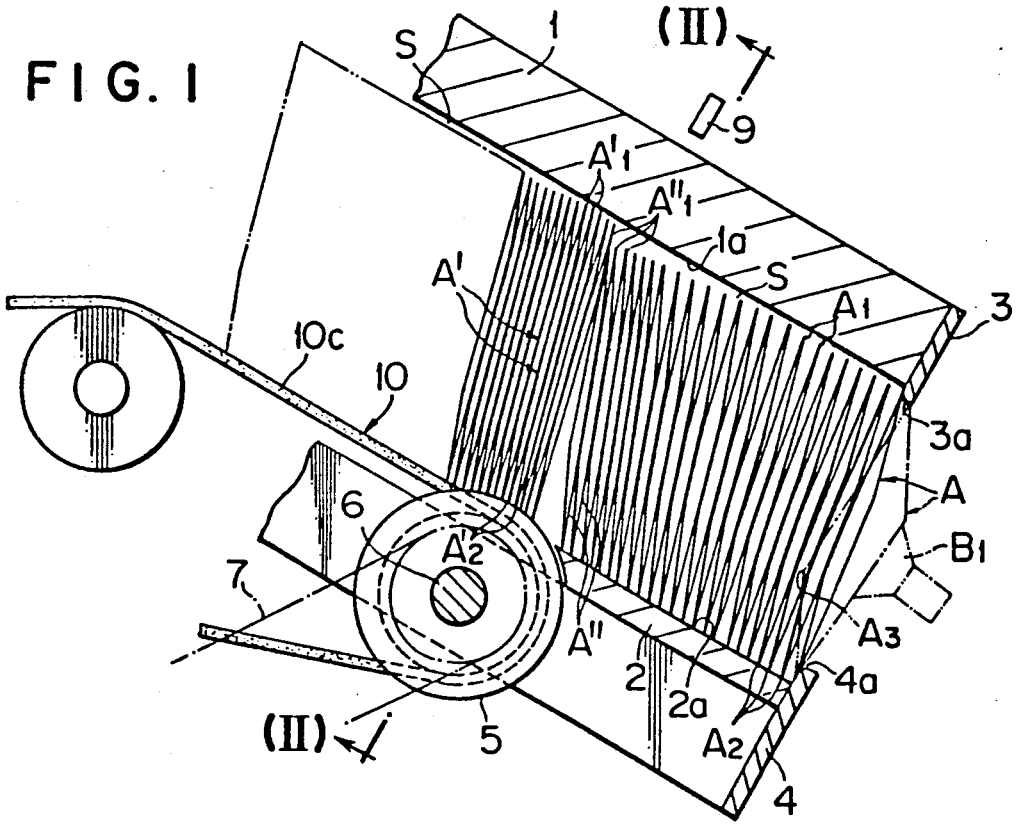

The present invention is described herein as relating in particular to a magazine for flatwise folded cartons. However, it is contemplated that other articles can be supplied and stored by the apparatus described and claimed herein.

The present invention has been created in view of conventional apparatus and it is a first object of the present invention to eliminate the frictional resistance of edges of cartons with respect to the inner surface of each of the guides, thereby permitting the cartons to move freely and, at the same time, completely preventing jamming and accidental discharging of the cartons and, still further, completely eliminating the pressure from the upstream side of the apparatus with respect to the cartons located on the downstream side, thereby permitting the cartons on the downstream side to move freely.

It is a second object of the present invention to partially open a carton being withdrawn.

It is a third object of the invention to permit the replenishment of cartons without functional deterioration of the supply portion for supplying a large quantity of cartons even when the same supply portion is at a desired angle, ranging from a horizontal to a vertical position.

It is a fourth object of the invention to permit the selection of the most suitable pressure to be applied to the carton located at the downstream end according to the material, size, paper thickness and shape of the carton, or the state and duration of storage.

It is a fifth object of the present invention to eliminate jamming of cartons between the guides in the situation in which the size of the cartons being conveyed is variable, even in the case in which both edges of the carton in a direction perpendicular to a folding line direction are held between the paired guides.

It is a sixth object of the present invention to reduce the force required to withdraw the cartons while preventing the accidental discharging of the carton located at the most downstream end of the magazine.

Technical means are provided by the present invention in order to solve the above-mentioned problems such that a gap is formed between the inner surface of a first, upper one of a pair of guides and one of two vertically spaced edges of each carton in a stacked condition. Each of the inwardly projecting stoppers is attached oppositely to the downstream ends of the guides so that the spacing between the stoppers is less than the inter-edge distance of each folded carton. At least one feed roller is disposed in a suitable position with respect to a second, lower one of the guides so as to project inwardly from the inner surface of the guide, and so that the distance from the circumferential surface of the feed roller to the inner surface of the first guide is less than the edge-to-edge dimension of each folded carton. A sensor is provided for controlling the operation of the feed roller in accordance with a decrease in the number of cartons positioned downstream of the feed roller.

It is preferable that the stoppers at the downstream ends of the paired guides have curved or inclined inner end faces formed so that the spacing therebetween becomes gradually narrower toward the downstream end, that a conveyance portion for supplying a large quantity of cartons is disposed upstream of the other of the paired guides, the conveyance portion being adapted to operate in synchronism with the feed roller, and that the mounting position of the feed roller is made adjustable in the direction in which the cartons are stacked, i.e., along the length of the supply channel.

In addition, the distance between the inner surfaces of paired guides located downstream of the feed roller is made greater than the distance between the inner surfaces of the paired guides located upstream of the feed roller, and each of the stoppers is oppositely projected so as to engage with both edges which extend in the direction of the folding lines of the folded cartons, the distance between the projecting stoppers being less than the edge-to-edge dimension of the edges of the folded cartons in a direction of their folding lines.

According to the above-mentioned technical means of the present invention, on the downstream side of the magazine, both edges of the lead carton in the magazine are positioned and retained by both stoppers so that the carton is stopped from sliding, while upstream therefrom, both edges of a carton are brought into pressure contact with the surface of the feed roller and the inner surface of the first guide, thereby allowing the carton to prevent the upstream pressure from being exerted on the cartons positioned downstream of the feed roller. In this way, not only is the free elasticity of the cartons retained between the most downstream carton and the carton engaged by the feed roller, but also the push-back operation is smoothly performed for the succeeding cartons created by the tendency of each carton to expand toward an open position in the stacked carton direction, i.e., along the feed channel of the magazine, when the carton is withdrawn by the suction cup or other such device. As a result, the backward inclination of the cartons based on the rocking and the lessening of pressure of the stacked cartons is facilitated, and the cartons are successively withdrawn from the downstream end of the magazine. Then, upon detection by the sensor of a decrease in the number of the cartons positioned downstream of the feed roller, the same roller is operated to push up the cartons into abutment with the inner surface of one guide while replenishing the shortage intermittently.

When the carton positioned at the downstream end is withdrawn from between both stoppers by virtue of suction of the suction cup, e.g., both edges of the carton are brought into sliding contact with the curved or inclined end faces of the stoppers and they are thereby compressed in a direction toward each other. The conveyance portion for supplying a large quantity of cartons is operated in synchronism with the feed of cartons by the feed roller, whereby the same quantity of cartons as that of the cartons fed by the feed roller are replenished to the upstream side of the feed roller, and the feed roller is movably positioned in the carton stacked direction to thereby selectively increase or decrease the number of cartons positioned downstream of the feed roller to the downstream end of the magazine.

Further, the pressure applied from the upstream side may cause the cartons located downstream of the feed roller to easily slide, and both edges of cartons in which the distance between them in a direction perpendicular to a direction of the folding lines of the cartons is considerably variable, are not engaged by both stoppers, but both edges of cartons in which the distance between them in the direction of folding lines is not significantly variable are engaged.

A specific embodiment of the present invention will now be described with reference to the drawings.

As shown in FIG. 1, both upper and lower flat guides 1 and 2 for holding flatwise folded cartons A in a stacked condition are inclined at an angle of about 30 degrees with respect to a horizontal plane at which the cartons A can be drawn out easily by a suction cup $B_1$ preferably moving along a hypotrochoid path.

The upper and lower guides 1 and 2 are each constituted by a flat plate or plural plates arranged side-by-side in spaced relation in the direction of the feeding of the cartons, and having a smooth inner surface. Lower edges $A_2$ of the cartons A are slidably placed on an inner surface 2*a* of the lower guide 2, and the upper and lower guides 1 and 2 are spaced from each other so as to form a gap S between upper edges $A_1$ of the stacked cartons A and the inner surface of the upper guide. From the downstream ends of both of these guides 1 and 2 each of upper and lower stoppers 3 and 4 project inwardly, either perpendicularly or at an acute angle relative to the inclination angle of both guides, so that the spacing between the inner ends of the upper and lower stoppers 3 and 4 is less than the vertical width of the folded cartons A, i.e., in the preferred embodiment, the edge-to-edge width dimension in a direction perpendicular to a folding line direction of cartons A.

Consequently, the upper and lower edges $A_1$ and $A_2$ of the carton A positioned at the downstream end strike the upper and lower stoppers 3 and 4 and are held substantially perpendicularly or at an acute angle relative to the inclination angle of both guides 1 and 2, and cartons A are stacked and held successively on the upstream side.

The upper and lower stoppers 3 and 4 have curved inner end faces 3*a* and 4*a*, respectively, or inclined inner end faces, continuous to the downstream ends of upper and lower guide inner surfaces 1*a* and 2*a* and are formed so that the spacing therebetween becomes gradually narrower towards the downstream side of the magazine.

In a suitable position of the lower guide 2, more specifically at a suitable length on the upstream side from the downstream end, at least one feed roller 5 is disposed projecting upwardly from the inner guide surface 2*a* and is adapted to rotate only toward the downstream side in the stacked direction of cartons A. The feed roller 5 is mounted so that the distance from the upper reach of the feed roller 5 to the upper guide inner surface 1*a* is less than the vertical width of the folded cartons A.

Figure 2:
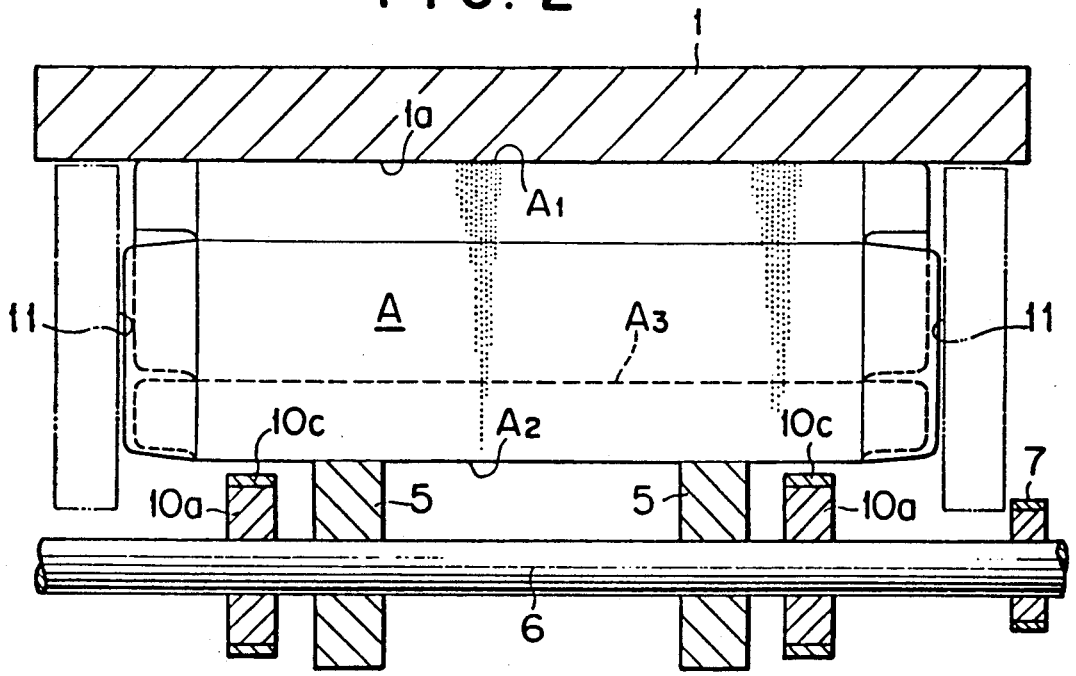

In this embodiment, as illustrated in FIG. 2, a pair of right and left feed rollers 5 are fixed in an appropriately spaced relation to each other onto a rotary shaft 6 extending generally horizontally below the lower guide 2 in a direction generally perpendicular to the stacked direction of the cartons A, the rotary shaft 6 being connected to a motor 8 through a transfer belt 7. If desired, a single feed roller, of perhaps greater length, could be generally centrally positioned on shaft 6.

Upon rotation of the feed rollers 5 with operation of the motor 8, a carton A, positioned upstream of the feed rollers 5 is pushed upwardly while being fed toward the downstream side, resulting in that an upper edge $A_1'$ thereof abuts the upper guide inner surface 1*a* and the carton is slightly opened while its upper and lower edges $A_1'$ and $A_2'$ are held in pressure contact with the upper guide inner surface 1*a* and the feed rollers 5, respectively. But the carton will not be opened to a greater extent because of a constant application of pressure to the carton A' from the upstream side. When the feed rollers 5 are stopped in this state, the carton A, receives the pressure created by stacked cartons on the upstream side.

The motor 8 is electrically connected to a drive controlling sensor 9 and, in accordance with a drive signal provided from the sensor 9, the motor 8 causes the feed rollers 5 to rotate faster than the carton drawing-out speed of the later-described suction cup $B_1$, or stops the rollers 5.

In this embodiment, the drive controlling sensor 9 is a diffuse reflection type photoelectric sensor, which is disposed in an opposed relation to an upper edge $A_1''$ of a carton A'' positioned downstream of the feed rollers 5. When the upper edge $A_1''$ is in a preset height position and the quantity of reflected light corresponds to a present quantity, the sensor 9 does not produce a drive signal to the motor 8 so that the motor remains stopped. But, where the carton A'' tilts with the carton withdrawing operation of the suction cup $B_1$ to increase the spacing from the upper edge $A_1$, and the quantity of reflected light changes, the sensor 9 determines that the quantity of cartons is less than a desired amount, and continues to provide a drive signal to the motor 8 until the quantity of reflected light returns to the preset level.

Upstream of the lower guide 2, more specifically, upstream of the feed rollers 5, there is disposed a conveyance portion 10 of a supply conveyor for supplying a large quantity of cartons, which conveyance portion is adapted to advance in synchronism with the rollers 5.

The conveyance portion 10 for supplying a large quantity of cartons is preferably a conveyer belt generally contiguous with the inner surface 2*a* of the lower guide 2. In this embodiment, a pair of right and left driving pulleys 10*a* are mounted on the rotary shaft 6, and a pair of conveyer belts 10*c* are entrained in the stacked direction of cartons A about the driving pulleys 10*a* and, also, about a pair of driven pulleys 10*b* disposed upstream of the driving pulleys. A large quantity of cartons A are placed in a stacked condition on the conveyer belts 10*c*, which belts are driven simultaneously with rotation of the feed rollers 5, whereby the cartons are replenished at the upstream side of the feed rollers.

Figure 3:
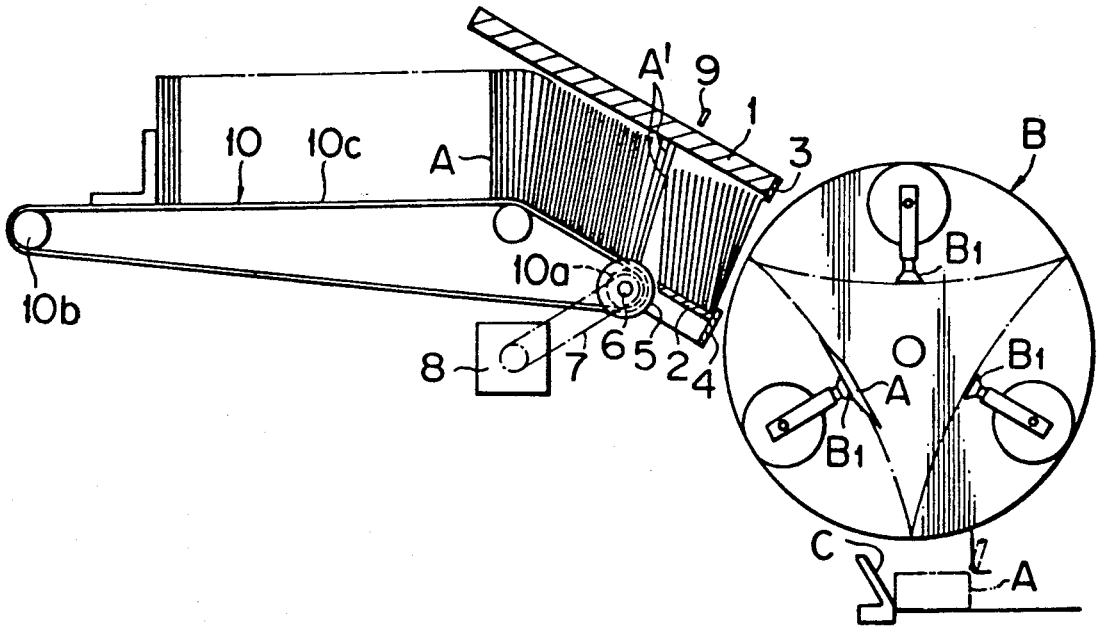
Figure 4:
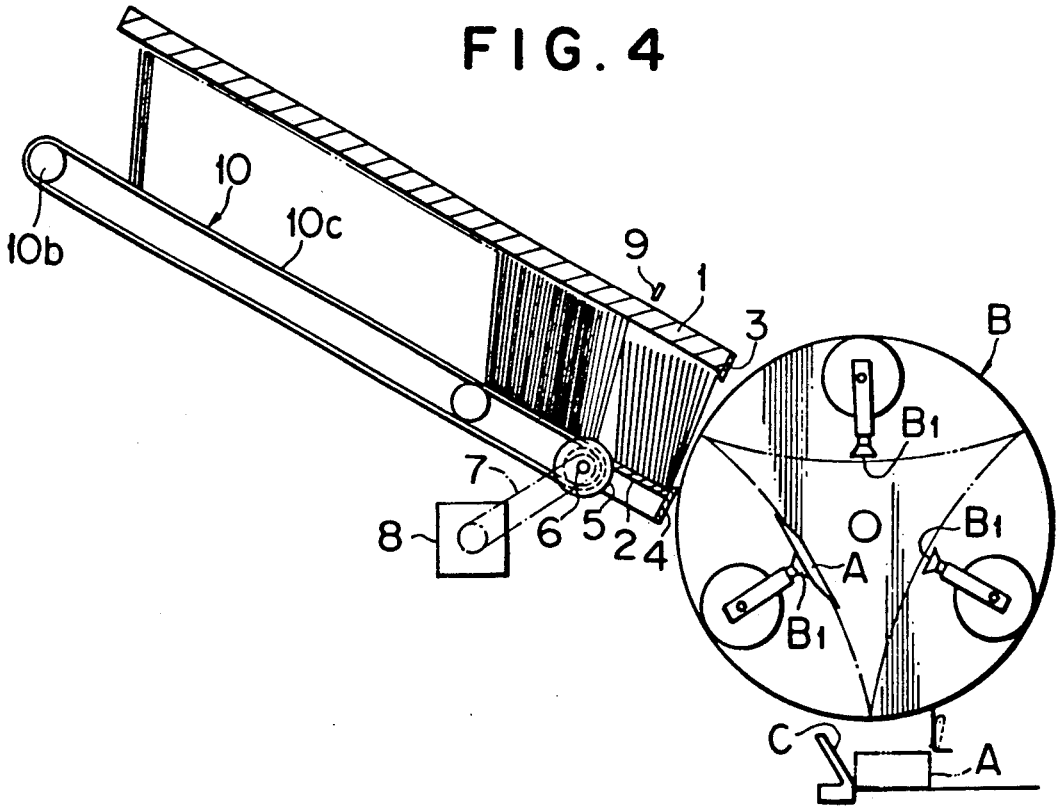

The carton carrying surfaces of the conveyer belts 10*c* are adjustable in position from generally horizontal, shown in FIG. 3, to a position inclined downwardly from upstream to downstream, shown in FIG. 4, by vertically changing the position of the driven pulleys 10*b* located at the upper end of the supply conveyor.

Although the driving pulleys 10*a* are mounted coaxially with the feed rollers 5 on the rotary shaft 6, the apparatus of the invention is not limited to such an arrangement. The driving pulleys 10*a* may be supported by a shaft separate from the rotary shaft 6 and may be driven directly from the motor 8 through transfer belts. In this case, plural conveyer belts 10*c* of a relatively small width or, alternatively, a single conveyer belt of a relatively large width may be utilized.

Further, on the downstream side of the upper and lower. stoppers 3 and 4 there is disposed a rotatable transfer mechanism B which preferably includes three planetary gear trains meshing with a fixed gear, and suction cups $B_1$ connected to outer-end gears of the planetary gear trains. This mechanism is shown schematically in FIGS. 3 and 4.

In the rotatable transfer mechanism B, the planetary gear trains rotate along the outer periphery of the fixed gear, whereby the suction cups $B_1$ are each moved along a hypotrochoid path. With regard to each suction cup $B_1$, suction is started before it passes between the upper and lower stoppers 3 and 4. The carton A positioned at the downstream end is engaged by the suction of a suction cup $B_1$ while being slightly pushed back and is then withdrawn from the magazine by means of the suction cup $B_1$, which cup then moves downwardly and brings the carton into pressure contact with a fixed inclined guide C to open the carton squarely. Thereafter, the suction is discontinued.

The operation of the magazine thus constructed will now be more fully explained. First, in an initial state, the upper and lower edges $A_1$, and $A_2$ of the carton A positioned at the downstream end strike the upper and lower stoppers 3 and 4 so that the sliding motion of the cartons at the downstream side is stopped, while the pressure from the upstream side is received by the cartons A' whose upper and lower edges $A_1'$ and $A_2'$ are held in pressure contact with the circumferential surfaces of the feed rollers 5 and the inner surface 1*a* of the upper guide, whereby the cartons A positioned downstream of the cartons A' are movably held within the respective ranges of elasticity of the folded cartons therein.

A suction cup $B_1$ moving along the hypotrochoid path of the transfer mechanism B comes into contact with the carton A located at the downstream end and pushes it back toward the upstream side. In response to the pushing back of the most downstream carton, the cartons A positioned downstream of the feed rollers 5 are compressed and slide toward the upstream side. The carton A at the downstream end then moves, following the suction cup $B_1$ and is begun to be withdrawn to the downstream side by the suction cup $B_1$.

At this time, as the suction cup $B_1$ begins to withdraw the carton A, the upper and lower edges $A_1$ and $A_2$ of the most downstream carton are brought into sliding contact with the curved inner end faces 3*a* and 4*a*, or inclined faces, of the upper and lower stoppers 3 and 4, and are thus gradually compressed toward each other, and thus the carton begins to open.

Simultaneously, a rear edge $A_3$ of the carton A moves towards the upstream side, although this movement is also absorbed by compression and the upstream slide of the cartons A positioned downstream of the feed rollers 5.

When the most downstream carton A has been withdrawn completely, the next carton adjacent thereto slides downstream until it is stopped by the upper and lower stoppers 3 and 4, whereupon the cartons positioned downstream of the feed rollers 5 also slide downstream successively.

When the carton withdrawing operation is repeated several times, the cartons positioned downstream of the feed rollers 5 gradually tilt and the position of their upper edges $A_1''$ become lower. The drive controlling sensor 9 detects this condition and drives the motor 8 to rotate the feed rollers 5, wherein the cartons A positioned upstream of the feed rollers 5 are delivered to the downstream side at a higher speed than the carton withdrawing speed of the suction cup $B_1$.

In synchronism therewith, the conveyer belts 10*c* which constitute the conveyance portion 10 for supplying a large quantity of cartons operate to replenish the cartons A to the upstream side of the feed rollers 5.

As a result, the number of cartons A on the downstream side of the feed rollers 5 gradually increases and the cartons A" positioned downstream of the rollers gradually assume their upright positions so that the positions of their upper edges $A_1''$ rise. This change in position is detected by the sensor 9, which stops the operation of the motor 8 to discontinue the carton feeding operation of the feed rollers 5 and the conveyer belts 10*c*.

Thereafter, the above operations are repeated with regard to a successive carton.

Right and left end faces of each carton A are guided by a pair of right and left guides 11 as shown, e.g., in FIG. 2. The right and left guide walls 11 and the upper and lower guides 1, 2 are so constructed as to be adjustable in size according to the particular sizes of cartons A. For example, guides 1, 2, and 11 can be adjustably mounted for movement toward and away from the supply channel.

Figure 5:
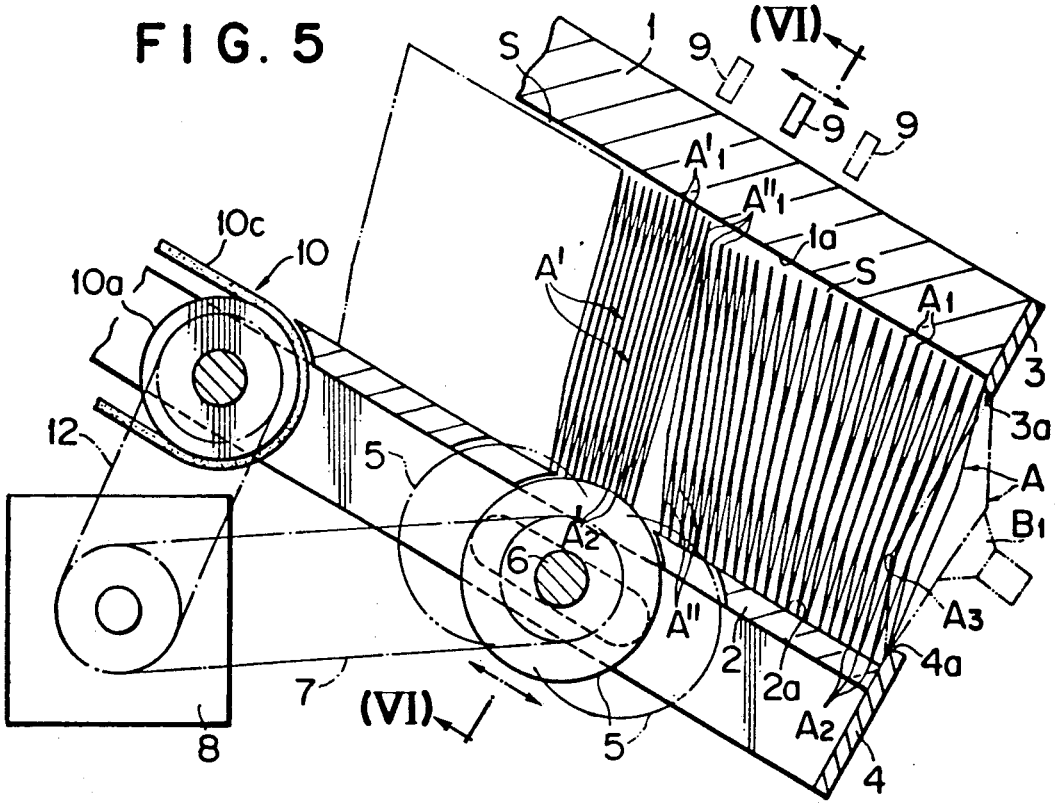
Figure 6:
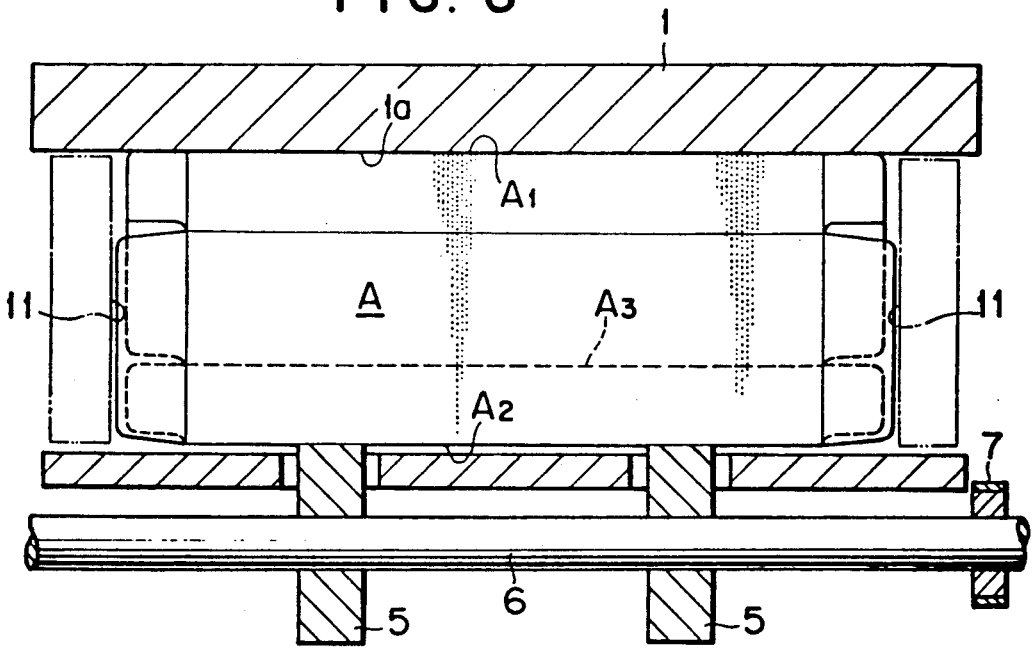

FIGS. 5 to 11 show another embodiment, wherein the feed rollers 5 in FIGS. 5 and 6 are movable in the stacked direction of cartons A along the supply channel, and the drive-controlling sensor 9 is also made correspondingly movable.

Further, the driving pulleys 10*a* of the conveyance portion 10 for supplying a large quantity of cartons are supported by a shaft separate from the rotary shaft 6 and are connected to the motor 8 through a transfer belt 12.

Consequently, the number of cartons A held between the feed rollers 5 and the upper and lower stoppers 3, 4 in FIGS. 5 and 6 is adjustable to adjust the pressure to be imposed on the carton A positioned at the downstream end according to the material, size, paper thickness, and shape of cartons A, or the state and duration of storage of cartons A, thereby permitting the cartons to be withdrawn exactly in a half-opened condition.

Figure 7:
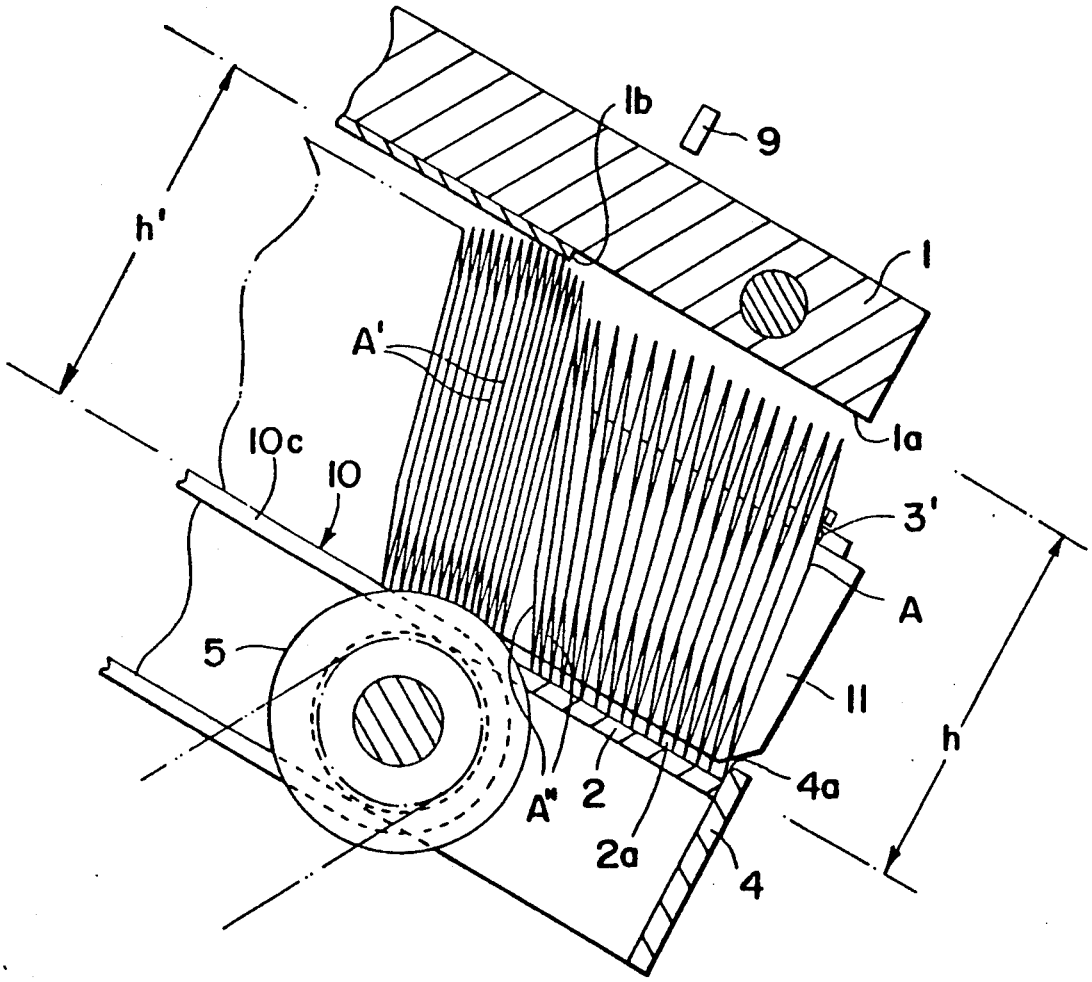
Figure 8:
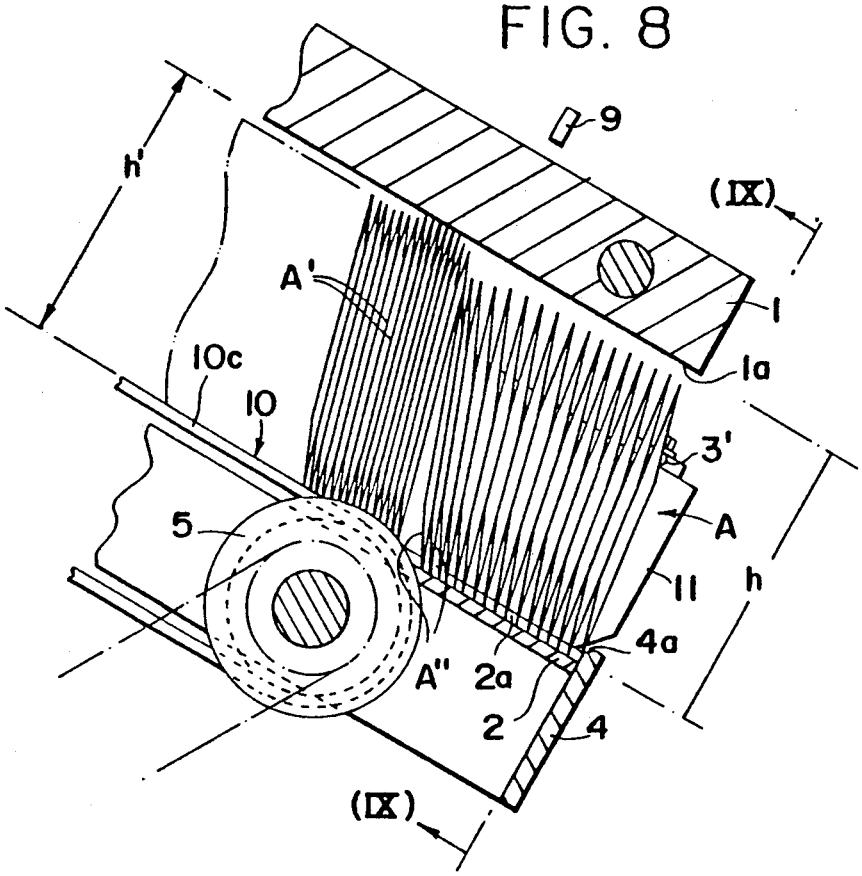

Further, the arrangement shown in each of FIGS. 7 and 8 is constructed such that distance h between the inner surfaces of the upper and lower guides 1 and 2 located downstream of the feed rollers 5 is greater than the distance h' between the inner surfaces of the upper and lower guides 1 and 2 located upstream of the feed rollers 5

The arrangement shown in FIG. 7 is made such that the inner surface 1*a* of the upper guide includes an offset, or stepped, part 1*b* which is separately or integrally formed opposite to the most-projected position of the feed rollers 5. The upper guide inner surface 1*a* positioned at the downstream side of the stepped part 1*b* is arranged slightly, higher, in parallel form, as compared with the upper guide inner surface 1*a* located at the upstream side of the stepped part 1*b*. In addition, the arrangement in FIG. 8 is made such that the inner surface 2*a* of the lower guide 2 located downstream of the feed rollers 5 is arranged slightly lower, in parallel form, as compared with the inner surface of the lower guide 2 located upstream of the feed rollers 5 or the upper surfaces of the conveyer belts 10*c* and 10*c* of a transporting part 10 for supplying a large quantity of cartons as illustrated in the drawing.

Accordingly, the arrangements shown in each of FIGS. 7 and 8 show that the cartons A" at the downstream side of the feed rollers 5, to which carton pressure from the upstream side is shut off, may easily slide and, even if the vertical edge-to-edge dimension of the folded cartons A is varied, no jamming of the cartons A occurs between the vertical guides 1 and 2 at the downstream side of the feed rollers 5, in particular. Therefore, it is possible to prevent the erroneous operation of the driving control sensor 9 generated by clogging of the cartons A.

Figure 9:
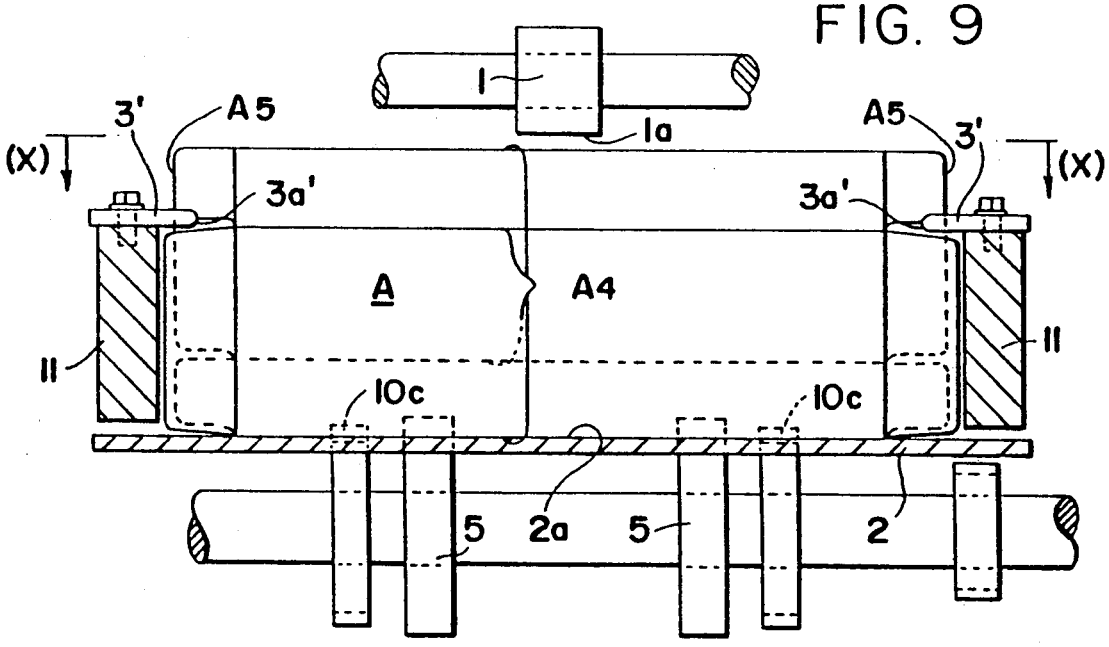
Figure 10:
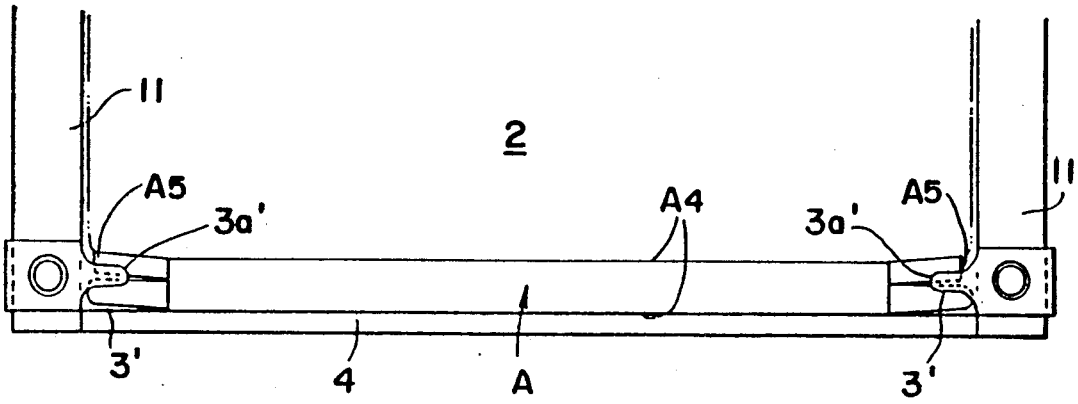

The arrangements shown in FIGS. 8, 9, and 10 are constructed to include side stoppers 3' and 3' which are oppositely projected. Both side stoppers 3' and 3' can be adjusted in their projecting directions, in their height directions, and in the overlapping direction of the cartons A with respect to the right and left guides 11 and 11. A distance between the curved surfaces 3*a'* and 3*a'*, or slanted surfaces, are formed smaller than the inter-edge dimension in the direction of the folding lines $A_4$ of the folded carton A, i.e., the lateral width dimension.

Accordingly, since the arrangements shown in FIGS. 8 to 10 are constructed so as to take advantage of the fact that the distance between both edges $A_5$ and $A_5$ in the direction of the folding line $A_4$ of the carton A does not vary. Accordingly, due to the use of side stoppers 3' and 3', the pressure on the carton A as it is being withdrawn is reduced while the accidental discharging of the carton A located at the most downstream end of the magazine is prevented.

Although the oppositely projecting side stoppers 3' and 3' are shown in place of the upper stopper 3, they are not to be so limited, and such side stoppers can also be provided in place of the lower stopper 4. In this case, in place of the lower stopper 4, the projecting amount of the projecting side stoppers can be set to project greater than the side stoppers 3' and 3' provided in place of the upper stopper 3, thereby the engaging force for the cartons A is increased.

Figure 11:
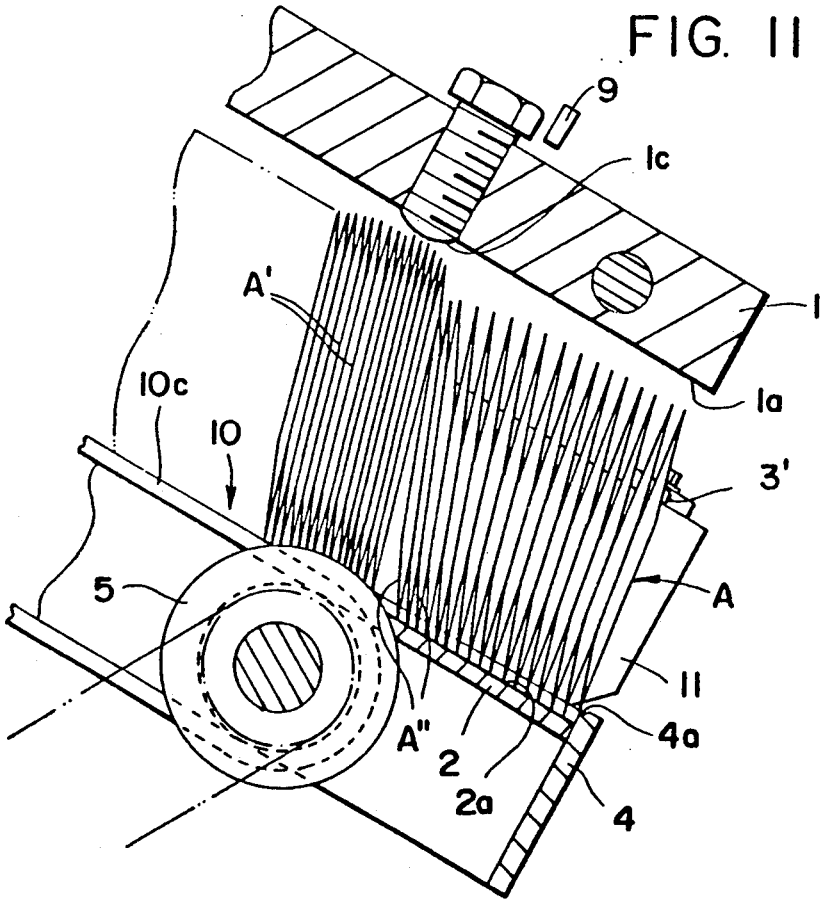

Further, the arrangement shown in FIG. 11 is made such that a projection 1*c* projects from inner surface 1*a* of the upper guide 1 opposite to the position where the feed rollers 5 project in such a way that the amount that it projects may be adjusted. As shown, this projection is a generally smooth lower surface of a threaded member. Alternatively, this projection could comprise a member attached to such a threaded member which includes a surface extending laterally between side walls 11, and which is thereby adjustable toward and away from the lower surface.

Accordingly, the arrangement shown in FIG. 11 has the effect that a pressure shielding action from the upstream side to the downstream side of a carton A is effected through the surface of the feed rollers 5 and the inner surface 1*a* of the upper guide, i.e., the squeezing action is improved to enable the projecting amount of the feed rollers 5 from the inner surface 2*a* of the lower guide to be adjusted, and then a fine adjustment of the above-mentioned squeezing amount may easily be performed with surface 1*c* and, thereby, an adjusting operation can be facilitated.

The present invention, as described above, has the following advantages:

Both edges of the carton positioned at the downstream end are retained by both stoppers and stop sliding, while on the upstream side both edges of a carton are held in pressure contact with the surfaces of the feed rollers and the inner surface of one guide, thereby allowing the carton to serve as a shutoff to prevent the upstream-side pressure from being exerted on the downstream cartons. In this way, not only is a free elasticity of the cartons retained, but also there is smoothly performed a push-back operation for the successive cartons induced by opening of each carton, involving expansion in the carton stacked direction when the carton is withdrawn by the suction cup. As a result, the backward inclination of the cartons based on the tilting and the loosening of the pressure of the stacked cartons is facilitated and the cartons are withdrawn successively from the one positioned at the downstream end. Then, upon detection by the sensor of a decrease in the number of the cartons positioned downstream of the feed rollers, the rollers are operated to push the cartons upwardly into abutment with the inner surface of one of the guides while replenishing the shortage intermittently. Therefore, even in the event of occurrence of slight variations in the width of cartons, it is possible to eliminate frictional resistance at both ends of the carton with respect to the inner surface of each of the guides, to permit the free movement of the carton, to completely prevent jamming and accidental dropping of cartons. Further, the movement of the cartons located downstream of the rollers can be done smoothly by isolating those cartons from upstream pressure.

Accordingly, as compared with the conventional magazine which does not operate properly unless cartons are made uniform in their vertical width, it is easier to effect the quality control for cartons and material costs can be reduced. Further, the suction time of the suction cup can be made longer to ensure the suction as compared with the conventional magazine wherein resistance is developed during the push back of the cartons during suction.

When the downstream carton is withdrawn from between the stoppers by virtue of the suction engagement with the suction cup, both edges of the carton are brought into sliding contact with the curved or inclined end faces of the stoppers and both edges of the cartons are thereby compressed toward each other. That is, the sliding contact motion of the carton is converted to an opening action tending to expand the carton in the stacked direction, thus permitting the carton to be partially opened as it is withdrawn.

Consequently, fully square opening is ensured as compared with the conventional magazine in which the carton is withdrawn in a compressed state.

The conveyance portion for supplying a large quantity, of cartons is operated in synchronism with the feed of cartons by the feed rollers, whereby cartons in the same quantity as those fed by the feed rollers are replenished to the upstream side of the feed rollers, so that the replenishment of cartons can be ensured without functional deterioration of the conveyance portion, even when the same portion changes in its angle from horizontal to vertical or vertically inclined.

Therefore, in comparison with the conventional magazine wherein cartons are replenished into the magazine through a horizontal conveyer, the conveyance portion for supplying a large quantity of cartons can be disposed according to the particular configuration of the installation site.

Since the number of cartons held between the feed rollers and the downstream end of the magazine can be increased or decreased by adjusting the position of the feed rollers in the stacked direction of the cartons, it is possible to select the most suitable pressure to be applied to the downstream carton according to the material, size, paper thickness and shape of the cartons or the state and duration of storage of cartons.

Thus, the magazine of the present invention can cope with all kinds of cartons, whereas conventional magazines can cope with only a limited variety of cartons.

Since the carton at the downstream side of the feed rollers where the shielding of the pressure from the upstream side is facilitated, even in case that both edges in a direction perpendicular to a direction of the folding lines of the cartons are held between the paired guides, it is possible to eliminate jamming of the cartons between the guides as the size of the carton is varied and, further, an erroneous operation of the driving control sensor generated by the jamming of the cartons can be prevented.

So, as compared with the conventional system in which the carton may easily be jammed, the handling necessary for removing the carton can be saved and an efficiency of operation can be improved.

The edges of the cartons for which the distance between them in a direction perpendicular to the direction of the folding lines of the carton tending to vary in size are not engaged by the stoppers, but the edges of the cartons, the distance between which do not vary in size in the folding direction, are engaged, so that even in case that both edges of the carton in a direction perpendicular to the direction of the folding lines of the carton are held between the paired guides, the force required to withdraw the carton can be reduced while accidental discharging of the carton located at the most downstream end of the magazine is prevented.

Thus, the operation of the present invention can be made more positive.

Although the invention has been disclosed as utilizing particular means, elements, and structural details, the invention is not limited thereto, but extends to all equivalents embraced by the claims as set forth below. For example, in the rotatable transfer mechanism B described in the above embodiments, three planetary gear trains are engaged with a fixed gear and suction cups $B_1$ each move along a hypotrochoid path. However, the invention is not limited to a transfer mechanism of this construction in which the cartons are withdrawn in their stacked direction by means of suction cups. It is to be understood that a linear mechanism or other known means may, alternatively, be adopted.

Further, although the upper and lower guides 1 and 2 are shown to be inclined at an angle of about 30 degrees with respect to a horizontal plane, this is not to be understood to constitute a limitation. Further, although a diffuse reflection type photoelectric sensor is described herein as the drive controlling sensor 9, any other means for detecting a decrease in the number of cartons can be utilized. Its mounting position may be changed accordingly.

What is claimed is:

1. A magazine for holding a plurality of stacked, flatwise folded cartons which are to be singularly withdrawn therefrom at a downstream end thereof, said magazine comprising:

an upper guide and a lower guide each having a respective inner surface between which said stacked cartons are held, said upper guide and said lower guide being spaced apart by a distance greater than a given distance between a pair of edges of respective cartons in their flatwise folded condition, thereby creating a gap at least at said downstream end of said magazine between said upper guide and one of said pair of edges of respective cartons;

a first stopper and a second stopper oppositely projecting from respective portions of said magazine toward each other, said first stopper and said second stopper being spaced apart by a distance less than a given distance between a pair of edges of said cartons;

at least one feed roller, at least a portion of which projects from said lower guide surface toward said upper guide surface and is spaced from said upper guide surface by a distance less than said given distance between said pair of edges of said respective cartons, said distance by which said upper guide and said lower guide are spaced apart being greater downstream of said one feed roller than said distance upstream of said one feed roller;

means for driving said at least one feed roller for rotation toward said downstream end of said magazine; and a sensor operatively associated with said driving means for controlling said rotation of said at least one feed roller as a function of the quantity of cartons positioned downstream of said at least one feed roller.

2. A magazine according to claim 1, wherein each of said stoppers has an inner end face such that a spacing is defined between said inner end face of said first stopper and said inner end face of said second stopper which gradually decreases toward said downstream end of said magazine.

3. A magazine according to claim 2, wherein said inner end face of each of said stoppers is curved.

4. A magazine according to claim 2, wherein said inner end face of each of said stoppers is inclined.

5. A magazine according to claim 1, further comprising a supply conveyor having a conveyance portion disposed upstream of said second guide for supplying a plurality of cartons, wherein said conveyance portion is adapted to be driven in synchronism with said at least one feed roller.

6. A magazine according to claim 1, wherein said feed roller is mounted for selective adjustment toward and away from said downstream end of said magazine.

7. A magazine according to claim 1, wherein the folded cartons which are to be held in said magazine have folding lines which extend in a predetermined direction and along which said folded cartons are folded, wherein said first stopper and said second stopper are positioned relative to said magazine so as to be adapted to engage opposite edges of said folded cartons, which edges are space from each other in the direction of the folding lines of said folded cartons.

8. A magazine according to claim 7, wherein said lower guide supports said cartons on edges of said cartons, said magazine further comprising a third stopper projecting upwardly from said lower guide, and wherein said first stopper and said second stopper projected generally perpendicularly to said third stopper.

9. A magazine according to claim 8, wherein said gap is positioned between respective upper edges of said cartons and said upper guide and wherein said first stopper, said magazine defining a pathway for said cartons, said second stopper and said third stopper are the sole stoppers projecting into said pathway for said cartons, no stopper thereby projecting from said upper guide.

10. A magazine according to claim 1, wherein said upper guide has an upstream portion, upstream of said feed roller, and a downstream portion, downstream of said feed roller, wherein said downstream portion of said upper guide defines a surface which is spaced from said lower guide by an amount greater than an amount by which said upstream portion of said upper guide is spaced from said lower guide.

11. A magazine according to claim 10, wherein said upstream portion of said upper guide and said downstream portion of said upper guide are non-continuous.

12. A magazine according to claim 11, wherein said downstream portion of said upper guide extends generally parallel to said upstream portion, said upstream portion defined by a stepped guide portion.

13. A magazine according to claim 10, wherein said upstream portion of said upper guide and said downstream portion of said upper guide are continuous.

14. A magazine according to claim 1, wherein said lower guide has an upstream portion, upstream of said feed roller, and a downstream portion, downstream of said feed roller, wherein said downstream portion of said lower guide defines a surface which is spaced from said upper guide by an amount greater than an amount by which said upstream portion of said lower guide is space from said upper guide.

15. A magazine according to claim 14, wherein said upstream portion of said lower guide and said downstream portion of said lower guide are non-continuous.

16. A magazine according to claim 15, wherein said downstream portion of said lower guide extends generally parallel to said upstream portion, said upstream portion defined by a stepped guide portion.

17. A magazine according to claim 14, wherein said upstream portion of said lower guide and said downstream portion of said lower guide are continuous.

18. A magazine according to claim 1, wherein said magazine is generally horizontally oriented.

19. An apparatus for storing folded articles in a supply and for facilitating withdrawal of said articles from said supply, said articles having fold lines which extend in a predetermined direction, and at least a pair of edges which are spaced from each other in said predetermined direction, said apparatus comprising:

(a) means for guiding said articles for movement from an upstream position to a downstream position comprising at least two guide surfaces;

(b) a discharge end located at a downstream portion of said guiding means for which said articles can be withdrawn from said supply;

(c) means located along said guiding means, upstream of said discharge end, for substantially isolating a first quantity of said articles in said supply from a second quantity of said articles positioned upstream of said first quantity of said articles, said guide surfaces being spaced apart by a distance downstream of said isolating means greater than a distance upstream of said isolating means; and (d) at least a pair of stoppers which are positioned downstream of said isolating means so as to be adapted to engage said articles proximate said pair of edges, said pair of stoppers extending in a direction generally transverse to said pair of edges.

20. The apparatus of claim 19 wherein said guiding means comprises at least two generally parallel guide surfaces.

21. The apparatus of claim 20 wherein said at least two guide surfaces comprise a lower guide surface upon which said articles within said supply are to be supported on respective additional edges, said additional edges being other than said pair of edges, ad an upper guide surface adapted to be spaced from said lower guide surface at a distance greater than a predetermined width dimension of one of said articles.

22. The apparatus of claim 19 wherein said means for isolating comprises means for temporarily engaging and advancing at least one of said articles in said supply towards said discharge end of said supply.

23. The apparatus of claim 22 wherein said means for temporarily engaging and advancing comprises an intermittently driven roller.

24. The apparatus of claim 23 wherein said means for isolating comprises means for engaging and advancing at least one of said articles in said supply, said means for engaging and advancing being positioned proximate one of said at least two guide surfaces and at least partially projects from said one of said at least two guide surfaces toward a second of said at least two guide surfaces by a distance less than a predetermined width dimension of one of said articles.

25. The apparatus of claim 22, wherein said guiding means comprises at least two generally parallel guide surfaces, and wherein said means temporarily engaging and advancing comprises means projecting from one of said two guide surface which is adjustable toward and away from the other of said two guide surfaces.

26. The apparatus of claim 25, wherein said isolating means comprises a roller projecting from said other of said two guide surfaces and which is positioned generally opposite to said adjustable means.

27. The apparatus of claim 19 wherein said articles are flatwise folded cartons and wherein said apparatus further comprises means for facilitating at least partial opening of said folded cartons.

28. The apparatus of claim 27 wherein said means for guiding comprises at least two guide surface sand wherein said means for facilitating at least partial opening of said folded cartons comprises said pair of stoppers.

29. The apparatus of claim 28 wherein said pair of stoppers comprise a first projection and a second projection which are spaced apart by a distance less than a width dimension of at least one of said cartons such that, upon engagement of a first portion of a respective carton at said discharge end by a withdrawal mechanism for withdrawing said respective carton from said supply, second and third opposed portions of said carton engage respective portions of said first and second projections to thereby enable said respective carton to be at least partially opened.

30. The apparatus of claim 29 wherein said first projection and said second projection comprise respective surfaces which converge toward said discharge end of said apparatus.

31. The apparatus of claim 30 wherein said respective surfaces are substantially planar.

32. The apparatus of claim 30 wherein said respective surfaces are curved.

33. A magazine according to claim 19 wherein said means for isolating comprises means for engaging and advancing at least one of said articles in said supply, said means for engaging and advancing being positioned proximate one of said at least two guide surfaces and at least partially projecting from said one of said at least two guide surfaces toward a second of said at least two guide surfaces to be spaced from said second guide surface by a distance less than a predetermined width dimension of one of said articles.

34. A magazine according to claim 33 wherein said means for engaging and advancing comprises a roller which engages and advances said at least one of said articles in said supply.

35. An apparatus according to claim 19, wherein said apparatus for storing articles is generally horizontally oriented.

36. An apparatus for storing articles in a supply and for facilitating withdrawal of said articles from said supply, said apparatus comprising:

(a) means for guiding said articles for movement from an upstream position to a downstream position comprising at least two spaced apart guide surfaces having respective upstream portions and downstream portions;

(b) a discharge end located at a downstream portion of said guiding means form which said articles can be withdrawn from said supply, said two guide surfaces being spaced apart, at least at said discharge end, by a distance greater than a predetermined width dimension of one of said articles and wherein the distance between said two guide surfaces is greater downstream than upstream; and (c) means located along said guiding means, upstream of said discharge end, for substantially isolating a first quantity of said articles in said supply from a second quantity of said articles positioned upstream of said first predetermined number of said articles.

37. The apparatus according to claim 36 wherein said two guide surfaces comprise a lower surface and an upper surface and wherein said upper surface comprises a stepped portion and a portion which is not stepped, said stepped portion projecting closer to said lower surface than said portion which is not stepped, said stepped portion being spaced from said discharge end and extending upstream therefrom.

38. The apparatus according to claim 36 wherein said two guide surfaces comprise a lower surface and an upper surface and wherein said lower surface includes an upstream portion and a downstream portion, and wherein said downstream portion is spaced from said upper surface by a distance greater than that of said upstream portion.

39. An apparatus according to claim 36, wherein said apparatus for storing articles is generally horizontally oriented.

40. A method of feeding flatwise folded cartons, each having a predetermined width and fold lines extending in a predetermined direction, through a magazine, from an upstream portion to a downstream portion, and of facilitating withdrawal of said cartons from said magazine comprising:

(a) creating a supply of stacked cartons within said magazine;

(b) guiding said folded cartons within said magazine between an upstream position to a downstream end by means of at least a pair of generally parallel guide surfaces spaced apart, at least at said downstream portion of said magazine, by a distance greater than said predetermined width of said cartons to thereby define a gap between a first edge of each of said stacked cartons and one of said guide surfaces;

(c) engaging a respective second edge of at least one of said cartons within said magazine and moving said at least one of said cartons toward and against a second of said guide surfaces to thereby isolate an upstream quantity of cartons from a downstream quantity of cartons; and (d) engaging opposite end portions of successive cartons at a discharge end of said magazine at which said cartons are successively withdrawn, said end portions being spaced from each other generally in said predetermined direction in which fold lines of said cartons extend.

41. The method of claim 40 further comprising the step of engaging, at said discharge end of said magazine, an edge portion which extends generally parallel to said fold lines of said cartons.

42. The method of claim 41 wherein said edge portion includes said second edge.

43. The method of claim 40 wherein said pair of generally parallel guide surface comprise an upper guide surface and a lower guide surface, wherein said step of guiding said folded cartons comprises guiding said folded cartons by supporting respective said second edges of said cartons.

44. The method of claim 43, wherein said cartons have a predetermined height between said first edge and said second edge, said method comprising the additional step of guiding a further quantity of cartons having a height which is different from said predetermined height.

45. The method according to claim 40, wherein said flatwise folded cartons are fed through a magazine which is generally horizontally oriented.

46. An apparatus for storing folded articles in a supply and for facilitating withdrawal of said articles from said supply, said articles having fold lines which extend in a predetermined direction, and at least a pair of edges which are spaced from each other in said predetermined direction, said apparatus comprising:

(a) means for guiding said articles for movement in a direction from an upstream position to a downstream position comprising at lest two guide surfaces;

(b) a discharge end located at the most downstream portion of said guiding means from which said articles can be withdrawn from said supply;

(c) means located along said guiding means, upstream of said discharge end, for substantially isolating a first quantity of said articles in said supply from a second quantity of said articles positioned upstream of said first quantity of said articles; and (d) means for engaging said articles proximate said pair of edges for arresting movement of said first quantity of articles at said discharge end of said guiding means and for permitting withdrawal of articles at said discharge end of said guiding means from said first quantity of articles generally in said direction.

47. An apparatus according to claim 46, said articles having respective further edges, wherein said means for isolating a first quantity of articles comprises means for engaging and moving said respective further edges of said articles toward and against one of said two guide surfaces.

48. An apparatus according to claim 46, said articles having respective further edges, wherein said means for guiding is oriented in a manner for generally supporting said articles on said further edges, whereby said means for isolating a first quantity of said articles further comprises means for causing said first quantity of articles to lean toward said second quantity of articles.

49. An apparatus according to claim 46, wherein said apparatus for storing folded articles is generally horizontally oriented.

* * * * *

UNITED STATES PATENT AND TRADEMARK OFFICE

CERTIFICATE OF CORRECTION

PATENT NO. : 5,131,899

DATED : July 21, 1992

INVENTOR(S) : T. NAGAHASHI et al.

It is certified that error appears in the above-identified patent and that said Letters Patent is hereby corrected as shown below:

At column 2, line 65 of the printed patent, delete "." after "thereof,".

At column 3, line 65 of the printed patent, delete "." after "number".

At column 4, line 21 of the printed patent, change "are" to ---an---.

At column 5, line 65 of the printed patent, delete "." after "embodiment".

At column 9, line 19 of the printed patent, change "A," to ---A'---.

At column 9, line 29 of the printed patent, change "A," to ---A'---.

At column 10, line 20 of the printed patent, delete "." after "lower".

At column 12, line 2 of the printed patent, insert ---.--- after "rollers 5".

At column 12, line 9 of the printed patent, delete ---,--- after "slightly".

At column 16, line 5 (claim 7, line 8) of the printed patent, change "space" to ---spaced---.

At column 16, line 47 (claim 14, line 8) of the printed patent, change "space" to ---spaced---.

At column 17, line 24 (claim 21, line 5) of the printed patent, change "ad" to ---and---.

At column 17, line 48 (claim 25, line 5) of the printed patent, change "surface" to ---surfaces---.

At column 17, line 59 (claim 28, line 2) of the printed patent, change "surface sand" to ---surfaces and---.

At column 18, line 41 (claim 36, line 10) of the printed patent, change "form" to ---from---.

UNITED STATES PATENT AND TRADEMARK OFFICE

CERTIFICATE OF CORRECTION

PATENT NO. : 5,131,899
DATED : July 21, 1992
INVENTOR(S) : T. Nagahashi et al

It is certified that error appears in the above-indentified patent and that said Letters Patent is hereby corrected as shown below:

At column 20, line 14 (claim 46, line 9) of the printed patent, change "lest" to --least--.

Signed and Sealed this

Twelfth Day of October, 1993

*Attest:*

*Attesting Officer*

BRUCE LEHMAN

*Commissioner of Patents and Trademarks*